US007293720B2

(12) United States Patent
Ramsay

(10) Patent No.: US 7,293,720 B2
(45) Date of Patent: Nov. 13, 2007

(54) FLUID BALANCED PAINT SYSTEM

(75) Inventor: Paul B. Ramsay, Alliston (CA)

(73) Assignee: Honda Motor Co., Ltd., Tokyo (JP)

( * ) Notice: Subject to any disclaimer, the term of this patent is extended or adjusted under 35 U.S.C. 154(b) by 314 days.

(21) Appl. No.: 10/698,857

(22) Filed: Oct. 31, 2003

(65) Prior Publication Data

US 2004/0154532 A1 Aug. 12, 2004

Related U.S. Application Data

(60) Provisional application No. 60/423,236, filed on Oct. 31, 2002.

(51) Int. Cl.
*B05B 1/34* (2006.01)

(52) U.S. Cl. ..... 239/76; 239/124; 118/313; 366/159.1; 366/341

(58) Field of Classification Search ..... 118/300, 118/313; 137/563; 239/124, 127, 76; 366/159.1, 366/336, 341

See application file for complete search history.

(56) References Cited

U.S. PATENT DOCUMENTS

| | | | | |
|---|---|---|---|---|
| 2,022,481 | A * | 11/1935 | Schellenger | 137/563 |
| 2,461,766 | A * | 2/1949 | Peeps | 222/146.4 |
| 2,546,741 | A * | 3/1951 | Grossman | 392/496 |
| 2,590,442 | A * | 3/1952 | Miller et al. | 392/496 |
| 2,604,854 | A * | 7/1952 | Taylor | 137/335 |
| 2,754,228 | A * | 7/1956 | Bede | 427/422 |
| 3,498,260 | A | 3/1970 | De Jean et al. | 118/70 |
| 3,720,373 | A * | 3/1973 | Levey | 239/127 |
| 4,243,527 | A | 1/1981 | Leonard | 210/785 |
| 4,392,366 | A | 7/1983 | Godfrey | 68/205 R |
| 4,561,380 | A | 12/1985 | Mulder | 118/688 |
| RE32,151 | E | 5/1986 | Scharfenberger | 427/8 |
| 4,592,305 | A | 6/1986 | Scharfenberger | 118/677 |
| 4,923,720 | A | 5/1990 | Lee et al. | 427/422 |
| 5,078,084 | A | 1/1992 | Shutic et al. | 118/309 |
| 5,171,613 | A | 12/1992 | Bok et al. | 427/422 |
| 5,312,862 | A | 5/1994 | Nielsen et al. | 524/552 |
| 5,418,271 | A | 5/1995 | Burba, III et al. | 524/436 |
| 5,549,755 | A | 8/1996 | Milovich et al. | 118/629 |
| 5,759,277 | A | 6/1998 | Milovich et al. | 118/629 |
| 5,997,692 | A | 12/1999 | Taylor et al. | 162/175 |
| 6,361,605 | B1 | 3/2002 | Shutic et al. | 118/308 |
| 6,395,406 | B1 | 5/2002 | Sangeeta | 428/650 |
| 2002/0014496 | A1 | 2/2002 | Cline et al. | 222/1 |

FOREIGN PATENT DOCUMENTS

| | | |
|---|---|---|
| JP | 06181407 | 8/1994 |

* cited by examiner

*Primary Examiner*—David Sorkin
(74) *Attorney, Agent, or Firm*—Schwegman, Lundberg & Woessner P.A.

(57) ABSTRACT

Disclosed herein is a paint circulation system for a painting line, comprising a supply channel, a return channel and a plurality of drop lines downstream of the supply channel and upstream of the return channel, a paint pump means for circulating paint through the supply channel, the drop lines and the return channel with a corresponding flow rate through each drop line, and means for establishing a flow controlling pressure differential between the supply channel and the return channel in each drop line which is directly proportional to the paint flow rate, wherein a change in the flow controlling pressure differential in a given drop line causes a corresponding proportional change in the paint flow rate through the given drop line.

26 Claims, 7 Drawing Sheets

FLUID BALANCED PAINT SYSTEM

REFERENCE TO CO-PENDING APPLICATIONS

The entire subject matter of U.S. Provisional application Ser. No. 60/423,236 filed Oct. 31, 2002 and entitled FLUID BALANCED PAINT SYSTEM is incorporated by reference. The applicant claims priority benefit under Title 35, United States Code, Section 119(e) of U.S. Provisional application Ser. 60/423,236 filed Oct. 31, 2002 and entitled FLUID BALANCED PAINT SYSTEM.

BACKGROUND OF THE INVENTION

1. Field of the Invention

The present invention relates to paint circulation systems, and more particularly to methods of controlling the flow of paint through such systems.

2. Description of the Related Art

Paint systems are widely used to paint a range of manufactured articles, such as automobiles. It is common, in almost all paint circulation systems, to pump the liquid paint from a central supply station and then to distribute the paint along a supply and return channel. A number of "drop" lines, are provided between the supply and return channels. From the supply side at each drop line a small flow of paint is directed along the "drop line" through a pressure regulator/pressure reducing valve to a "Colour Change Valve" where a first fraction is diverted to a spray gun and the remaining second fraction is delivered to the return channel. This results in a paint circulation system with many parallel flow paths. The flow in each of these parallel drop lines must be above a minimum velocity. Otherwise, paint "settling" can occur which can cause two problems:

1) the settling can cause dirt which can block the drop line altogether, thereby preventing paint from reaching the paint spray gun; and/or
2) the settled or coagulated paint will make it through the paint spray gun and will appear on the finished product as dirt, requiring expensive remedial repair, in some cases.

Of course, proper operation of these conventional paint circulation systems requires that they be configured so that the proper amount of paint is delivered to the each drop line. This starts with setting the minimum pressure on the return line to guarantee that enough pressure is available to deliver the target flow rate to the paint spray gun at the last drop (lowest pressure) on the system. This means that the last downstream connection between return line and a drop line is above that minimum pressure. This minimum "return line" pressure is set by a "back pressure" regulator at the central supply station.

Even though each drop line may be attached to a spray gun, the flow requirements between paint guns may change from one drop line to another. This might occur because a first spray gun may be used to spray a large area, therefore requiring a relatively high flow rate. On the other hand, a second spray gun may be used to spray a small area therefore requiring a relatively low flow rate. However, the first and second spray guns will usually have their own drop lines. This "drop line" pressure adjustment is conventionally made by a pressure regulator/pressure reducing valve which is located in the drop line and upstream of the CCV valve. The downstream pressure of the pressure regulator/pressure reducing valve must be set at a pressure higher than the pressure at the intersection of the drop joins and the return channel, by a value:

a) will overcome frictional pressure losses created by the paint at the correct flow rate;
b) will take into account "head" pressure changes as a result of any changes in elevation in the drop line between the downstream side of the pressure regulator/pressure reducing valve and intersection of the drop joins and the return channel.

Bearing these parameters in mind, the pressure drop between the pressure regulator/pressure reducing valve and the return line is typically in the 2 psi range. The minimum return line pressure is typically in the 100 to 150 psi range.

This means that the downstream pressure on the pressure regulator/pressure reducing valve must be set in the 102 to 152 psi range. As an example, if the minimum return channel pressure were to increase by 1 psi, the flow rate would decrease by 50%. If the return channel pressure were to increase by just 2 psi, the flow rate would decrease by 100%, or in other words would be completely shut off, leading to failure. When the pressure at the return line node is equal to the set point of the pressure regulator/pressure reducing valve, the flow in the drop line will shut off.

Typically, the return channel pressures at each intersection with a corresponding drop line are difficult to predict and are even more difficult to measure during set up because they tend to vary with minor upstream and downstream changes. This means that the system needs to be "balanced" and this is usually attempted at start up with a number of iterative adjustments to provide substantially the same flow travelling through each of the drop lines.

Conventionally, the flow through each drop line is obtained by setting the pressure to be just above the pressure at the intersection of the drop line and the return line. The pressure at the drop line to return channel is typically not known. This is problematic, since small changes in any part of the system can create pressure changes at the intersection of the drop line and the return line which can quickly cause sudden reductions or sudden spikes in flow in one or more of the drop lines, almost at random, which make these conventional systems chronically unstable, difficult to balance initially and difficult to maintain in a balanced condition during operation.

Conventional paint distribution systems are also problematic when changing paints. Changes in paint viscosity can cause additional random pressure variations. Changes in viscosity will occur between batches of paint, the temperature of the paint, how accurately the operator in the central supply station mixes the paint with solvents, how much of those solvents evaporate between adjustments to the viscosity by the operator.

Minor adjustments to the pressure regulator/pressure reducing valve in one or more drop lines will usually in turn cause a domino effect and prompt other random changes in other drop lines as a result. The problem is further aggravated, when due to these imbalances, settling occurs causing partial or complete blockage of a drop line causing further changes in flow and pressure drops in the system.

When a regulator/pressure reducing valve paint circulation system requires a new paint colour to be put into the system (due to new models/colour mixes) the system must be purged and cleaned. This is typically done with various types of cleaning solutions with viscosities that are very different than a paint's viscosity. The system has not been balanced for these new viscosities. Accordingly, some drops will likely have no flow and some others too much flow. Consequently, it is very difficult to clean these systems effectively. In this case, the regulators in each drop line must be backed off to zero pressure, otherwise some drop lines will randomly have no flow or not enough flow. Given the lack of balance between drop lines in this condition, the shut-off valves on all drop lines except one must be closed. Then, one valve for one drop line must be opened at a time in order to ensure that each drop line is cleaned. Cleaning can involve generally four or five progressive cleaning steps and a typical circulation system can easily have 30 drop lines, making the cleaning process a large and expensive task.

When the new paint is introduced at a different viscosity it can take up to five days to balance these systems with two trained operators. To do this effectively a flow meter must be inserted sequentially in each drop line and the pressure regulator/pressure reducing valve in the drop line must be adjusted until the correct flow is obtained. Each time the next drop line is adjusted it affects the flow rate through the previously adjusted drops. Thus, many iterations are required until all drops are within an acceptable range. This is an expensive time consuming process.

Part of maintaining a high quality painted product is to ensure that no dirt is contained in the painted surface of the product. The regulator/pressure reducing valve has a large volume where the diaphragm is located in which the paint flow velocity drops below that which prevents settling. This causes settling and coagulation of paint to occur, and this "coagulated paint dirt" can then make its' way directly to the finished product.

In order to balance these systems by pressure, a pressure gauge assembly is installed upstream and downstream of the pressure regulator/pressure reducing valve. The assembly has a tee in the drop piping, then a 4" to 6" long pipe, then an isolation ball valve, then an isolation diaphragm, then the pressure gauge. There is no flow through these assemblies. Instead, the paint is "dead". This again allows coagulation of paint creating dirt which, when it settles back into the main paint line, that can make its' way directly to the painted finished product.

The capital cost to provide the regulators/pressure reducing valves and pressure gauge assemblies and the labour to install them is a significant cost. The labour to remove and rebuild these assemblies as they wear out is significant.

In order to create the pressure drop, the regulator/pressure reducing valve has a needle valve which is actuated by a diaphragm. The orifice which is created by the needle valve and seat of the needle valve is very small. This creates a region of very high velocity fluid flow rate and correspondingly an area of very high shear rate. Also, there is very high energy dissipation in a tiny volume which creates a zone of very high energy density. When a paint containing metallic flake flows through this orifice the high energy dissipation and high shear rate crumple the flat "flake" into a ball. This ball does not reflect the light as flat flake will and causes a colour shift in the final painted product. The light is not reflected from the flake so the paint appears darker and dull as opposed to lighter with a sparkle.

Finished products that have dirt on them usually need to be repainted. Finished products that have been painted with damaged metallic flake may need to be totally repainted or scrapped. The repair of product and loss of product can be very expensive.

Paint is formed according to a precisely prepared paint formulation and usually includes a carrier and a number of additives to the carrier to provide the finished paint coating with a desired colour and with a desired finished effect such as a metallic or pearlescent effect, or a finish such as a high gloss. These additives are sophisticated and involve, in some cases, microscopic particles having a particular shape and particular multi-layered microlayers. It is not uncommon to encounter difficulties or inconsistencies in the finished paint coating which are believed to be caused, in part, by the damage to some of the additives through the orifice of the pressure regulator/pressure reducing valve.

Conventional paint systems are thus believed to require a relatively high capital cost. They are easily imbalanced resulting in more dirt and/or plugging, thereby requiring the difficult and time consuming job of flushing and rebalancing or recalibrating the system. Conventional paint systems thus have very high maintenance requirements and, given the above mentioned sensitivity to slight changes in the system, must be rebalanced if paint viscosity changes. This can involve, in some cases, a minimum of five eight hour shifts requiring a minimum of two manufacturing Associates.

Conventional paint systems by design create dirt which then makes its' way onto the final product causing expensive repairs. Conventional paint systems can destroy metallic paints if the paint is left too long in the system. Loss of the volume of paint contained in a paint circulation system is very expensive.

It is therefore an object of the present invention to address at least some of these problems.

SUMMARY OF THE INVENTION

In one of its aspects, the present invention provides a paint system comprising a paint supply station, a paint supply channel downstream of the paint supply station, the paint supply channel having a number of supply nodes, a paint return channel upstream of the paint supply station and a number of paint circulation lines, each paint circulation line including a coupling for connecting a paint output nozzle assembly thereto, each paint circulation line being positioned downstream of the paint supply channel at a corresponding supply node, each paint delivery line being positioned upstream of the paint return channel at a corresponding return node, each of said paint delivery lines further comprising a flow induced pressure generating portion for developing a differential pressure in the paint delivery line, the differential pressure being proportional to the magnitude of paint flow therein, each of the pressure generating portions being selected to generate sufficient differential pressure sufficient to provide an operative pressure differential at a corresponding paint output nozzle assembly, wherein each paint delivery line is substantially free of any component of sufficient size to cause accumulation of settled solids from a paint mixture to cause pressure changes to a degree requiring that the system be recalibrated or to cause settled solids to be deposited on a painted surface to a degree requiring remedial repair.

Preferably, each flow induced differential pressure generating portion includes a length of coiled tubing. However, other flow induced generating portions may be used. For example, the coil is in fact a long span of tubing. Therefore, the same flow inducing characteristics may be provided by providing a span of tubing in a configuration other than a coil, whose parameters are selected to provide the equivalent flow induced pressure differential. These parameters may include length, inner diameter, the number of bends in the configuration as well as the type of material used in the pipe, the latter of which will influence the coefficient of friction, the higher the coefficient of friction, the higher the flow resistance and the higher the pressure differential it will generate when a flow of paint travels through it. Other flow induced differential pressure generating portions may also be used such as multiple coils in series or parallel in a single drop line. Others may also be used that have low shear characteristics similar to those of relatively small diameter tubing, for instance.

In one embodiment, the paint circulation lines are in the form of paint drop lines. The paint output nozzle assembly is a paint spray gun, but may involve or include other arrangements such as flow meters, air operated pressure regulators, servo driven flow controllers, flushing systems and the like. Preferably, one or more than one paint spray gun can be coupled to a common drop line, as required.

In one embodiment, the coupling is a colour change valve, though the coupling can involve other valves and quick connect attachments, a manual regulator, or the like, or a combination thereof.

In one embodiment, the differential pressure in each paint drop line is produced entirely by a combination of differential sub-pressures including a first sub-pressure produced by the flow induced pressure generating portion, a second sub-pressure produced by paint drop line and the coupling and without a pressure regulator, or pressure reducing valve or a pressure gauge assembly or a combination thereof.

In another of its aspects, the present invention provides a paint system comprising a paint supply station, a paint supply channel downstream of the paint supply station, the paint supply channel having a number of supply nodes, a paint return channel upstream of the paint supply station and a number of paint circulation lines, each paint circulation line including a coupling for connecting a paint output nozzle assembly thereto, each paint circulation line being positioned downstream of the paint supply channel at a corresponding supply node, each paint circulation line being positioned upstream of the paint return channel at a corresponding return node, each of said paint circulation lines further comprising a flow induced pressure generating portion for developing a differential pressure in the paint delivery line, the differential pressure being proportional to the magnitude of paint flow therein, each of the pressure generating portions being selected to generate sufficient differential pressure sufficient to provide an operative pressure differential at a corresponding paint output nozzle assembly, wherein the pressure differential of all paint circulation lines is such that the design flow rate in every paint circulation line is substantially obtained in a stable and robust fashion, wherein changes in viscosity, provided the flow stays in the laminar flow zone, will cause the design flow rates in each and every paint circulation line to be substantially maintained.

In yet another of its aspects, the present invention provides a paint circulation system for supplying a paint mixture to a paint booth in a manufacturing operation, the paint circulation system comprising a number of paint drop lines supplying paint to a number of paint spray gun assemblies, each paint drop line including at least one Colour Change Valve for connecting at least one paint spray gun assembly thereto, each paint spray gun assembly being operative to spray a paint mixture received from the corresponding paint drop line at an operative flow rate, each paint drop line being positioned downstream of a paint supply node and upstream of a corresponding paint return node, each of said paint drop lines further comprising a means for generating differential pressure according to the operative flow rate, wherein each paint drop line is substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof.

In yet another of its aspects, the present invention provides a paint circulation system for supplying a paint mixture to a paint booth in an automobile manufacturing operation, the paint circulation system comprising a number of paint drop lines, each including a colour change valve for connecting at least one paint spray gun assembly thereto, each paint drop line being positioned downstream of a paint supply station and upstream of a paint return station, each of said paint drop lines further comprising a means for generating differential pressure according to an operative flow rate for the corresponding at least one spray gun assembly, wherein each paint drop line is substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof, wherein each paint drop line is free of pressure regulators, pressure reducing valves, pressure gauge assemblies, tees, standpipes, isolation valves, isolation diaphragms, or a combination thereof.

In yet another of its aspects, the present invention provides a paint circulation system for supplying a paint mixture to a paint booth in a manufacturing operation, the paint circulation system comprising a number of paint drop lines, each including a colour change valve for connecting a paint spray gun assembly thereto, each paint drop line being positioned downstream of a paint supply node and upstream of a paint return node, each of said paint drop lines further comprising a means for generating differential pressure according to a magnitude of paint flowing therein and under low shear flow conditions, wherein each paint drop line is substantially free of one or more sources of shear induced damage to additives contained in a paint mixture resulting in inconsistencies in a painted surface to a degree requiring remedial repair thereof.

In yet another of its aspects, the present invention provides a method of supplying a paint mixture to a paint booth in a manufacturing operation, comprising the steps of:

- providing a number of paint drop lines between a paint supply channel and a paint return channel;
- providing a coupling to connect at least one a spray gun assembly to each paint drop line;
- determining an operative pressure condition by determining an operative pressure differential between the paint supply channel and the paint return channel, in order to provide an operating pressure for the at least one spray gun assembly;
- installing a flow induced differential pressure generator in each drop line; and adjusting each differential pressure generator to satisfy the operative pressure conditions, and under low shear flow conditions, wherein each paint drop line is substantially free of any source of shear induced damage to additives contained in a paint mixture resulting in inconsistencies in a painted surface to a degree requiring remedial repair thereof.

In yet another of its aspects, the present invention provides a method of supplying a paint mixture to a paint booth in an automobile manufacturing operation, comprising the steps of:

- providing a number of paint drop lines between a number of paint supply nodes and a number of paint return nodes;
- providing a coupling to connect at least one a spray gun assembly to each paint drop line;
- determining operative pressure conditions by determining a pressure differential between the corresponding paint supply node and the corresponding paint return node to provide an operating pressure for each spray gun assembly;

installing a flow induced differential pressure generator in each paint drop line;

adjusting each differential pressure generator to satisfy the operative pressure conditions; and providing that each paint drop line is substantially free of one ore more components or dead spots of sufficient size to cause accumulation of settled solids from a paint mixture to cause pressure changes to a degree requiring that the system be recalibrated or to cause settled solids to be deposited on a painted surface to a degree requiring remedial repair thereof.

In yet another of its aspects, the present invention provides a paint circulation system for a painting line, comprising a supply channel, a return channel and a plurality of drop lines downstream of the supply channel and upstream of the return channel, and control means located in each drop line for controlling a flow rate of paint through each pressure drop, wherein the control means is operative to adjust the flow rate according to a flow controlling pressure differential, and wherein the flow controlling pressure differential is the pressure differential across the drop line between the supply channel and the return channel.

In yet another of its aspects, the present invention provides a paint circulation system for a painting line, comprising a supply channel, a return channel and a plurality of drop lines downstream of the supply channel and upstream of the return channel, a paint pump means for circulating paint through the supply channel, the drop lines and the return channel with a corresponding flow rate through each drop line, and means for establishing a flow controlling pressure differential between the supply channel and the return channel in each drop line which is directly proportional to the paint flow rate, wherein a change in the flow controlling pressure differential in a given drop line causes a corresponding proportional change in the paint flow rate through the given drop line.

In yet another of its aspects, the present invention provides a paint circulation system for an automotive painting line, comprising a supply channel, a return channel and a plurality of drop lines downstream of the supply channel and upstream of the return channel, a paint pump means for circulating paint through the supply channel, the return channel and at a drop line paint flow rate through the drop lines, and means for limiting changes to the drop line flow rate in a given drop line to within a proportional change in a flow controlling pressure differential in the corresponding drop line between the supply channel and the return channel.

In still another of its aspects, the present invention provides a paint circulation system for a painting line, comprising a supply channel, a return channel and a plurality of drop lines downstream of the supply channel and upstream of the return channel, and control means located in each drop line for controlling a flow rate of paint through each drop line, wherein the control means is operative to adjust the flow rate according to a flow controlling pressure differential, and wherein the flow controlling pressure differential is the pressure differential across the drop line between the supply channel and the return channel, wherein changes to viscosity in the paint do not result in changes to the system requiring recalibration between paint drop lines.

In one embodiment, changes may be made to readjust the pump supply pressure and back pressure regulator pressure settings or other parameters at a central paint supply station, for example.

In yet another of its aspects, the present invention provides a method of balancing a circulation system for a painting line, comprising the steps of:

providing a supply channel, a return channel and a plurality of drop lines downstream of the supply channel and upstream of the return channel;

providing a paint pumping unit to circulate paint through the supply channel, the drop lines and the return channel and at at least one drop line paint flow rate through each of said drop lines;

maintaining a flow controlling pressure differential in each drop line at a level substantially equal to the pressure differential in the drop line between the supply channel and the return channel; and making a proportional adjustment to flow rate through the drop line according to a change in the flow controlling pressure differential.

In yet another of its aspects, the present invention provides a method of balancing a circulation system for an automotive painting line, comprising the steps of:

providing a supply channel, a return channel and a plurality of drop lines downstream of the supply channel and upstream of the return channel;

providing a paint pumping unit to circulate paint through the supply channel, the drop lines and the return channel and at at least one drop line paint flow rate through each of said drop lines;

maintaining a flow controlling pressure differential in each drop line at a level substantially equal to the pressure differential in the drop line between the supply channel and the return channel; and limiting changes to the drop line flow rate in a given drop line to within a proportional change in a flow controlling pressure differential in the corresponding drop line between the supply channel and the return channel.

In still another of its aspects, the present invention a coating system comprising a coating materials supply station, a coating materials supply channel downstream of the supply station, the supply channel having a number of supply nodes, a coating materials return channel upstream of the supply station, the return channel having a number of return nodes, and a number of coating materials circulation lines, each circulation line including a coupling for connecting a coating materials output nozzle assembly thereto, each circulation line being positioned downstream of the supply channel at a corresponding supply node, each circulation line being positioned upstream of the return channel at a corresponding return node, each of said circulation lines further comprising a flow induced pressure generating portion for developing a differential pressure in the circulation line, the differential pressure being proportional to the magnitude of flow of coating materials therein.

In one embodiment, each flow induced differential pressure generating portion includes a length of tubing, which is coiled to form a coil. The coupling may include a colour change valve, a manual flow-through regulator with or without a quick-connect attachment.

The output nozzle assembly may include at least one of the following: a spray gun, a flow meter, an air-operated pressure regulator, a servo-driven flow controller, a flushing system or a combination of two or more thereof.

In one embodiment, the coiled or otherwise configured length of tubing has one or more predetermined coil parameters, including inner tube diameter, coil diameter, coil length, and coil pitch, one or more of which may be chosen according to a predetermined flow induced differential pressure. In one example, each coil includes stainless steel tubing and may have a diameter ranging from about ⅛ inch to about ½ inch, a wall thickness ranging from about 0.020 inches to about 0.065 inches, a coil diameter ranging from about 0.5 inches to about 12 inches and a pitch ranging from about ⅛ inches to about 1 inch. The coils may, in one case, include ¼ inch stainless steel tubing with length of about 20 inches, a 0.035 inch wall thickness, wherein the coils are 4 inches in diameter on a half inch pitch, and wherein the overall tube length of each coil is about 20 inches. Other dimensions may also be used in other circumstances, such as where higher flow rates are needed through the drop lines, for instance.

Exemplified embodiments of the present system are beneficial because they rely essentially entirely on the flow travelling through each drop line to produce the pressure therein, without the need and expense of devices which control pressure independent of flow.

In one example, the coating material fluid velocity in each parallel flow path as well as in the supply and return channels is set at a value that will preclude, or at least minimize, the settling of solids from the coating material. These velocities may range from about 0.1 meters per second to about 1.5 meters per second. The values are selected depending on the nature of the coating material. Since the drop lines are in parallel with one another, the flow in the supply line is shared by the drop lines and the flow in the return line is the accumulation from the flows in the "drops lines".

In another example, a supply channel distributes flow to each of the drop lines. However, in this case, the supply channel does not drain entirely into the drop lines but rather has a downstream end that drains into a reservoir tank at the supply station. The drop lines have downstream ends that drain into either one of two return lines which themselves drain into the reservoir.

In one embodiment, the average pressure drop across each drop line is set at a value that will provide a system that is stable while minimizing stress to the coating material.

The pressure is set by establishing the flow rate to be delivered in each drop line and by providing a flow-induced pressure generator to generate the desired pressure. This means that the flow in the parallel drop lines or flow paths should be substantially maintained at the set level. Minor variations in coating material such as viscosity and/or temperature should cause a corresponding minor change to the flow and pressure substantially equally in each drop line.

In other words, the flow induced pressure generating device is sized to match the pressure differential between the supply and return nodes and the pressure differential created by all of the components in the same drop line. For example, a drop line at one location in circulation system may be significantly longer than a second drop line at another location in the circulation system, simply to deliver the coatings mixture to a location farther away from the supply line. For example, the first drop line may have a CCV only a few feet from the supply line in an upper area of a paint booth, while a second drop line may be very long, in order to deliver paint to a CCV on a wrist of a robot down inside the paint booth. In the case of the first drop line, the fraction of the "pressure drop" (that is the change in pressure between the supply and return nodes) contributed by the drop line conduit and components may be considerably smaller than the fraction of the pressure drop contributed by same conduit or components in the second drop line.

In one embodiment, and while the flow is in the laminar flow range, the flow in each parallel flow path will remain equal to each other for any change in coating material viscosity, or change in overall differential pressure of the main supply and return circulation lines.

The terms coating, coating material and paint are intended to include coatings, coverings, basecoats, primers and other layers of materials which are suitable to be delivered in fluid form to a subject surface by way of a nozzle or other equivalent delivery device. The surface may be on an automobile or an automobile component or accessory or on another article such as a consumer product. The coating may be a solvent or water based with or without a solids phase including such things as additives for pearlescent effects such as coated or uncoated mica, or for other visual effects such as provided by metal flakes and the like, for colouring and tinting, including pigments containing titanium dioxide and others including particulate aluminum, zinc, copper, nickel, stainless steel and alloys thereof, and compounds selected from aluminum oxide, aluminum silicate, hydrated magnesium aluminum silicate, silica, mica aluminum silicate, magnesium oxide, calcium carbonate, calcium sulphate, calcium metasilicate, anhydrous sodium potassium aluminum silicate, sodium aluminum silicate, alumina trihydrate and barium sulphate. The coatings may also include film formers for solvent or aqueous bases in paint and lacquer formulations, such as those selected from acrylic, urethane, polyester, or melamine formaldehyde resins. The acrylic resins may include acrylamide, acrylonitrile, methyl acrylate, and ethylhexyl acrylate. The coatings may also include one or more additives selected from UV protectants, extenders, polymerization catalysts and rheology additives.

Preferably, each flow induced differential pressure generating portion includes a length of coiled tubing. However, other flow induced generating portions may be used. For example, the coil is in fact a long span of tubing. Therefore, the same flow induced pressure characteristics may be provided by providing a span of tubing in a configuration other than a coil, whose parameters are selected to provide the equivalent flow induced pressure differential. These parameters may include length, inner diameter, the number of bends in the configuration as well as the type of material used in the pipe, the latter of which will influence the coefficient of friction, the higher the coefficient of friction, the higher the flow resistance and the higher the pressure differential it will generate when a flow of paint travels through it. Other flow induced differential pressure generating portions may also be used such as multiple coils in series or parallel in a single drop line. Others may also be used that have low shear characteristics similar to those of relatively small diameter tubing, for instance.

In one embodiment, the paint circulation lines are in the form of paint drop lines. The paint output nozzle assembly is a paint spray gun, but may involve or include other arrangements such as flow meters, air operated pressure regulators, servo driven flow controllers, flushing systems and the like. One or more than one paint spray gun can be coupled to a common drop line, as required.

In one embodiment, the coupling is a colour change valve, though the coupling can involve other valves and quick connect attachments, a manual regulator, or the like, or a combination thereof.

In one embodiment, the differential pressure in each paint drop line is produced entirely by a combination of differential sub-pressures including a first sub-pressure produced by the flow induced pressure generating portion, one or more second sub-pressure produced by paint drop line and/or the coupling and without a pressure regulator, or pressure reducing valve or a pressure gauge assembly.

In another of its aspects, the present invention provides a paint system comprising a paint supply station, a paint supply channel downstream of the paint supply station, the paint supply channel having a number of supply nodes, a paint return channel upstream of the paint supply station and a number of paint circulation lines, each paint circulation line including a coupling for connecting a paint output nozzle assembly thereto, each paint circulation line being positioned downstream of the paint supply channel at a corresponding supply node, each paint circulation line being positioned upstream of the paint return channel at a corresponding return node, each of said paint circulation lines further comprising a flow induced pressure generating portion for developing a differential pressure in the paint delivery line, the differential pressure being proportional to the magnitude of paint flow therein, each of the pressure generating portions being selected to generate sufficient differential pressure sufficient to provide an operative pressure differential at a corresponding paint output nozzle assembly, wherein the pressure differential of all paint circulation lines is such that the design flow rate in every paint circulation line is substantially obtained in a stable and robust fashion, wherein changes in viscosity, provided the flow stays in the laminar flow zone, will cause the design flow rates in each and every paint circulation line to be substantially maintained.

In yet another of its aspects, the present invention provides a paint circulation system for supplying a paint mixture to a paint booth in a manufacturing operation, the paint circulation system comprising a number of paint drop lines supplying paint to a number of paint spray gun assemblies, each paint drop line including at least one colour change valve for connecting at least one paint spray gun assembly thereto, each paint spray gun assembly being operative to spray a paint mixture received from the corresponding paint drop line at an operative flow rate, each paint drop line being positioned downstream of a paint supply node and upstream of a corresponding paint return node, each of said paint drop lines further comprising a means for generating differential pressure according to the operative flow rate, wherein each paint drop line is substantially free from locations where solids from the paint mixture can accumulate to a degree requiring that the system be recalibrated and/or to cause settled solids to be deposited on a painted surface to a degree requiring remedial repair thereof.

In yet another of its aspects, the present invention provides a paint circulation system for supplying a paint mixture to a paint booth in an automobile manufacturing operation, the paint circulation system comprising a number of paint drop lines, each including a colour change valve for connecting at least one paint spray gun assembly thereto, each paint drop line being positioned downstream of a paint supply channel and upstream of a paint return channel, each of said paint drop lines further comprising a means for generating differential pressure according to an operative flow rate for the spray gun assembly, wherein each paint drop line is substantially free of locations to cause accumulation of settled solids from a paint mixture to cause pressure changes to a degree requiring that the system be recalibrated and/or to cause settled solids to be deposited on a painted surface to a degree requiring remedial repair thereof.

In yet another of its aspects, the present invention provides a paint circulation system for supplying a paint mixture to a paint booth in a manufacturing operation, the paint circulation system comprising a number of paint drop lines, each including a colour change valve for connecting a paint spray gun assembly thereto, each paint drop line being positioned downstream of a paint supply node and upstream of a paint return node, each of said paint drop lines further comprising a means for generating differential pressure according to a magnitude of paint flowing therein and under low shear flow conditions, wherein each paint drop line is substantially free of one or more sources of shear induced damage to additives contained in a paint mixture resulting in inconsistencies in a painted surface to a degree requiring remedial repair thereof.

In yet another of its aspects, the present invention provides method of supplying a coating composition to a coating line in a manufacturing operation, comprising the steps of:

- providing a number of drop lines between a number of supply nodes and a number of return nodes;
- providing a coupling to connect at least one coating delivery device to each drop line;
- determining an operative flow rate for the coating composition through each drop line;
- determining an operative pressure differential between the corresponding supply node and the corresponding return node in each drop line;
- providing a flow induced differential pressure generator in each drop line;
- and adjusting each differential pressure generator to generate the operative pressure differential according to the operative flow rate, and under low shear flow conditions, In one embodiment, the coupling includes a colour change valve, a manual regulator, a quick connect attachment, or a combination thereof.

In one embodiment, the method further comprises the steps of: providing a closed fluid circuit including a pumping station to deliver the coating composition to each of the supply nodes and to collect the coating composition from each of the return nodes, and maintaining the pressure at least one of the return nodes above a minimum level.

In one embodiment, the method further comprises the step of forming a table of pressure values for at least two designated locations in the closed fluid circuit according to a viscosity measurement of a coating composition therein therein.

In one embodiment, the method further comprises the steps of determining the viscosity of the coating composition; and adjusting the pressure at each of the designated locations in the fluid circuit according to the table of pressure values.

In yet another of its aspects, the present invention provides method of supplying a paint mixture to a paint booth in an automobile manufacturing operation, comprising the steps of:

- providing a number of paint drop lines between a paint supply channel and a paint return channel;
- determining an operative flow rate for the paint mixture through each drop line;
- providing a coupling to connect at least one a spray gun assembly to each paint drop line;
- determining operative pressure conditions by determining a pressure differential between the paint supply channel and the paint return channel to provide an operating pressure for each spray gun assembly;
- installing a flow induced differential pressure generator in each paint drop line;
- adjusting each differential pressure generator to satisfy the operative pressure conditions; and
- providing that each paint drop line is substantially free of one or more components or dead spots of sufficient size to cause accumulation of settled solids from a paint mixture to cause pressure changes to a degree requiring that the system be recalibrated or to cause settled solids to be deposited on a painted surface to a degree requiring remedial repair thereof.

In yet another of its aspects, the present invention provides a coating materials circulation system for a painting line, comprising a supply channel, a return channel and a plurality of drop lines downstream of the supply channel and upstream of the return channel, and control means located in each drop line for controlling a pressure differential across the drop line between the supply channel and the return channel, according to a flow rate of coating materials traveling through the drop line.

In yet another of its aspects, the present invention provides a paint circulation system for a painting line, comprising a supply channel, a return channel and a plurality of drop lines downstream of the supply channel and upstream of the return channel, a paint pump means for circulating paint through the supply channel, the drop lines having a corresponding flow rate there through each drop line, and means for establishing a flow induced pressure differential between the supply channel and the return channel in each drop line which is directly proportional to the paint flow rate, wherein a change in the flow induced pressure differential in a given drop line causes a corresponding proportional change in the paint flow rate through the given drop line.

In yet another of its aspects, the present invention provides a paint circulation system for an automotive painting line, comprising a supply channel, a return channel and a plurality of drop lines downstream of the supply channel and upstream of the return channel, a paint pump means for circulating paint through the supply channel, the return channel and at a drop line paint flow rate through the drop lines, and means for limiting changes to the drop line flow rate in a given drop line to within a proportional change in a pressure differential in the corresponding drop line between the supply channel and the return channel.

In still another of its aspects, the present invention provides a paint circulation system for a painting line, comprising a supply channel, a return channel and a plurality of drop lines downstream of the supply channel and upstream of the return channel, and control means located in each drop line for controlling a pressure differential across the drop line between the supply channel and the return channel, wherein changes to viscosity in the paint do not result in changes to the system requiring recalibration between paint drop lines.

In yet another of its aspects, the present invention provides a method of balancing a circulation system for a painting line, comprising the steps of:

providing a supply channel, a return channel and a plurality of drop lines downstream of the supply channel and upstream of the return channel;

providing a paint pumping unit to circulate paint through the supply channel, the drop lines and the return channel and at at least one drop line paint flow rate through each of said drop lines;

maintaining a flow induced pressure differential in each drop line at a level substantially equal to the pressure differential in the drop line between the supply channel and the return channel; and making a proportional adjustment to the flow rate through the drop line according to a change in the pressure differential.

In yet another of its aspects, the present invention provides a method of balancing a circulation system for an automotive painting line, comprising the steps of:

providing a supply channel, a return channel and a plurality of drop lines downstream of the supply channel and upstream of the return channel;

providing a paint pumping unit to circulate paint through the supply channel, the drop lines and the return channel and at at least one drop line paint flow rate through each of said drop lines;

maintaining a flow induced pressure differential in each drop line at a level substantially equal to the pressure differential in the drop line between the supply channel and the return channel; and limiting changes to the drop line flow rate in a given drop line to within a proportional change in the pressure differential in the corresponding drop line between the supply channel and the return channel.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
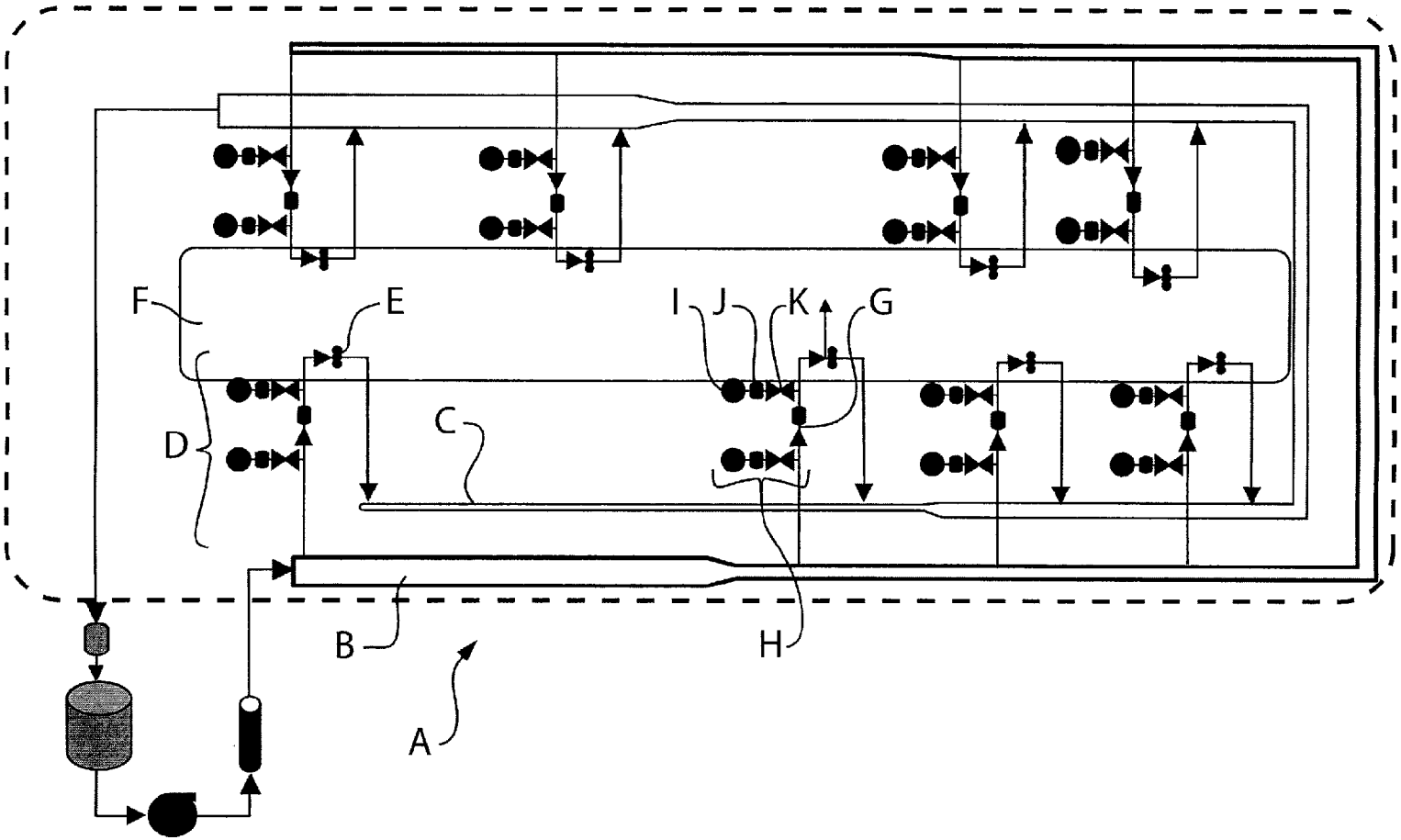
FIG. 1 is a schematic view of a paint system of the prior art.

A prior art paint system is shown at A in FIG. 1. It provides a supply channel B, a return channel C and a number of paint drop lines D there between to deliver paint to different paint Colour Change Valves (known as CCV's) shown at E. CCV's are well known in the field of paint circulation systems and will not be described further. Each drop line or delivery channel D is provided with a pressure regulator G, two pressure gauge assemblies H, each of which includes a pressure gauge I, an isolation diaphragm J, as well as an isolation valve and stand pipe for each pressure gauge, all of which are identified at K. The elements G, J and K are among the sources of the problems as mentioned above.

Figure 2:
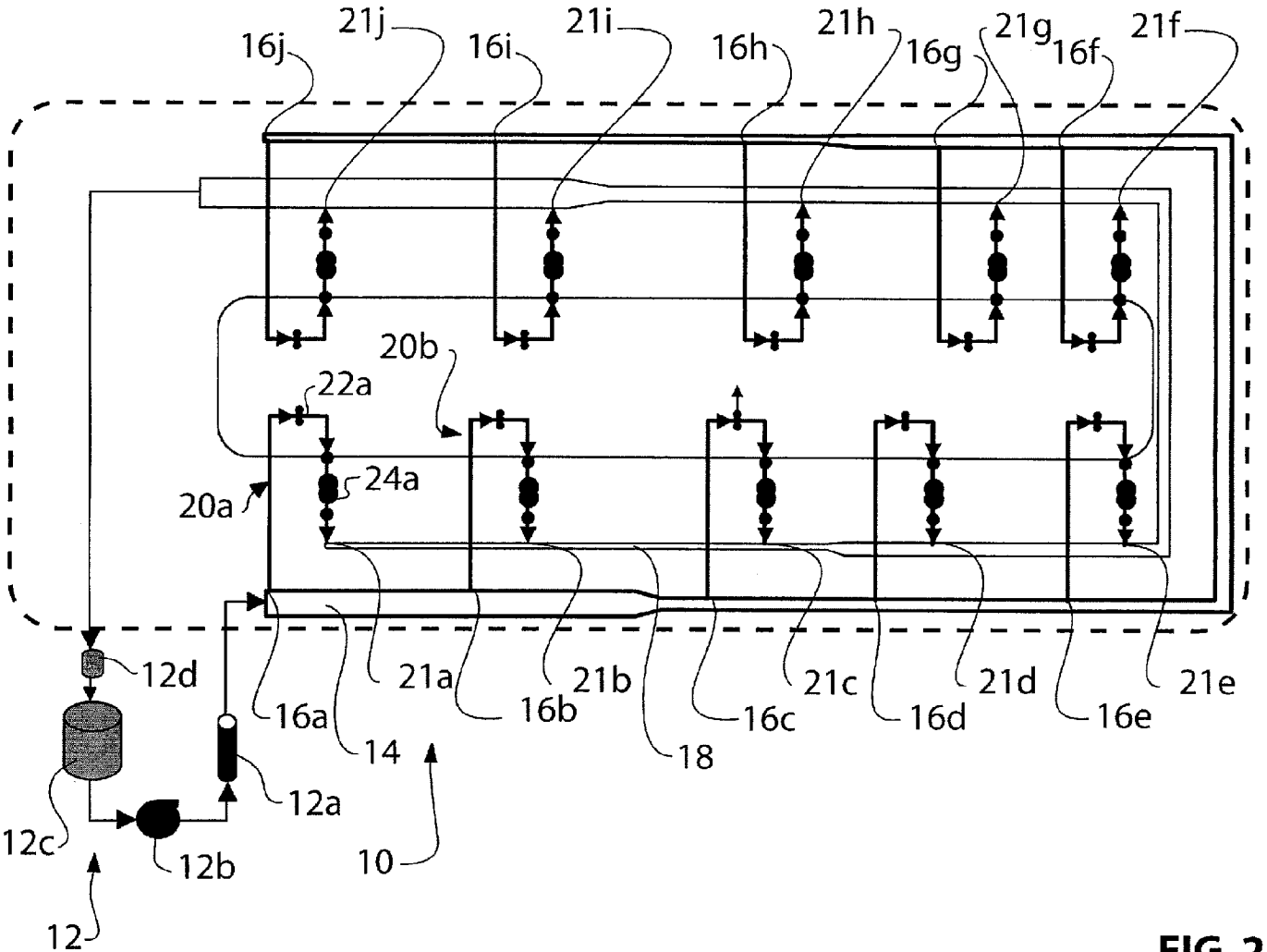
FIG. 2 is a schematic view of a 2 pipe fluid dynamically balanced paint circulation system.

One example of a paint system according to the present invention is shown at 10 in FIG. 2 having a central paint supply station 12 and a paint supply channel 14 downstream of the central paint supply station 12. The paint supply channel 14 provides a number of supply nodes 16*a-j*, (but can have many more or less as the specific painting application requires). A paint return channel 18 is provided upstream of the paint supply station 12. A number of paint circulation lines, referred to as "drop lines" (one of which is shown at 20*a*) are positioned downstream of the paint supply channel 14 at a corresponding supply node 16*a-j* and upstream of the paint return channel 18 at a corresponding return node 21*a-j*. For the sake of brevity, the details of each paint drop line will be considered equivalent to those of paint drop line 20*a*. However, there may, in some cases, be differences between the drop lines themselves depending, for example, on the requirements of the system downstream of the drop line, that can change from one drop line to another. The drop lines 20*a-j*, in fluid terms, are arranged in parallel, though the drop lines themselves may have different flow induced pressure characteristics.

The paint supply station 12 includes a filter 12*a*, a pump 12*b*, a reservoir tank 12*c* and a back pressure regulator 12*d*. In this case, the back pressure regulator may be of the "Low Shear" variety that are commercially available and which are desirable on paint circulation systems which supply basecoat metallic flake paints. The solid paints, such as those referred to as surfacers, tend not to contain metallic flakes and other additives susceptible to shear induced damage and, in that instance, other pressure regulators may be tolerated. It is contemplated, therefore, that the back pressure regulator 12*d* may, to a very minor degree, constitute a source for shear forces and high energy states but should have negligible effect on the system, in comparison with the conventional use of pressure regulators in the drop lines.

Figure 2A:
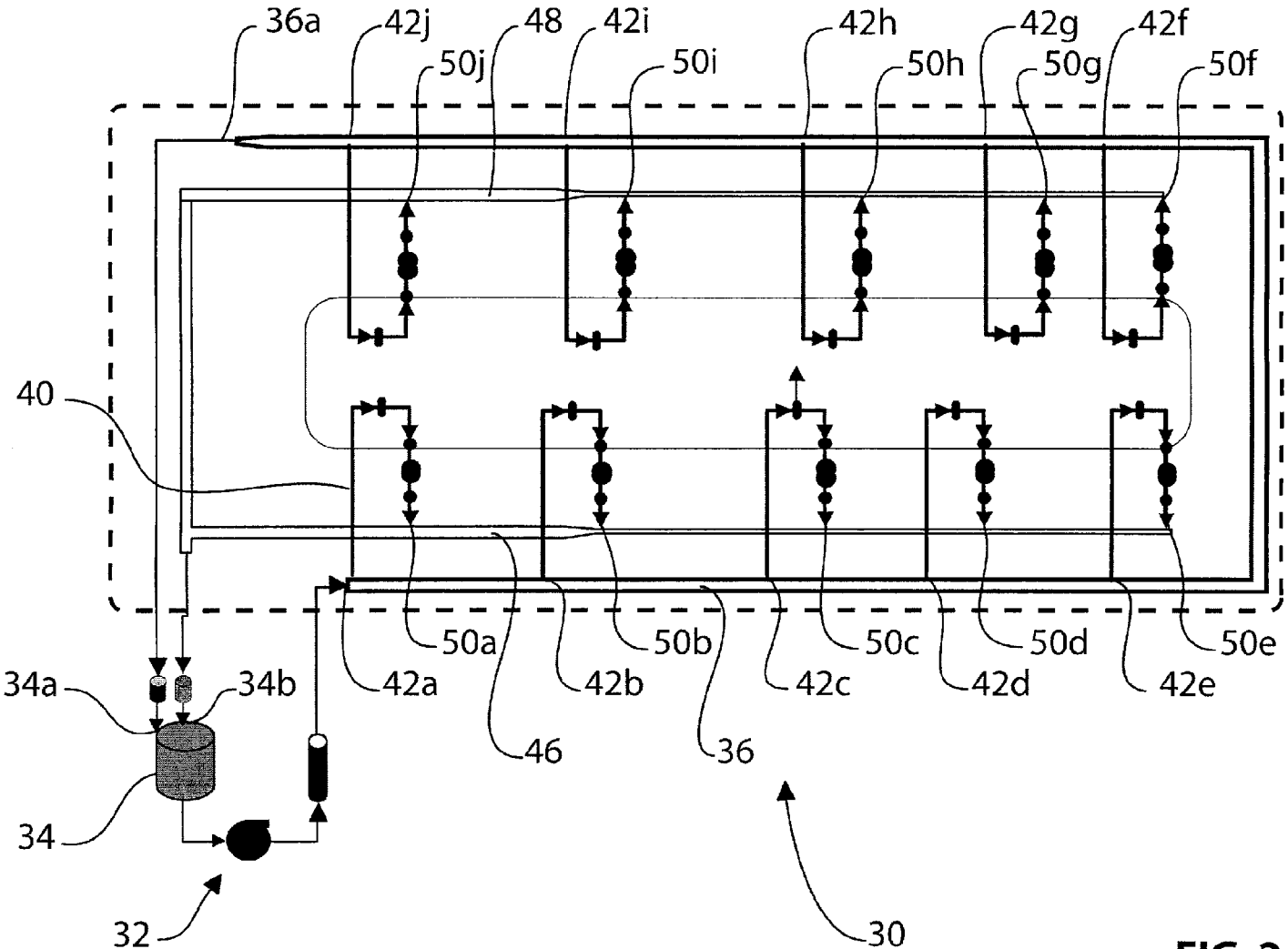
FIG. 2*a* is a schematic view of a 3 pipe fluid dynamically balanced paint circulation system.

The system of FIG. 2 is referred to as a "two pipe" system, the two pipes being the supply channel and the return channel. The system also can be applied to other systems such as a three pipe system, the latter being shown at 30 in FIG. 2*a*. In this case, the three pipe system 30 has a pump station 32 with a reservoir tank 34, a single supply line 36 whose downstream end 36*a* returns to a first inlet 34*a* of the reservoir tank 34. Each of the drop lines, shown at 40, are joined at their upstream ends to the supply line at supply nodes 42*a-j* while the downstream ends of the drop lines 40 are joined to one of two return lines 46, 48 at return nodes 50*a-j*. In this case, the two return lines are coupled with a common second inlet 34*b* of reservoir 34.

Referring once again to FIG. 2, the paint drop line 20*a* is provided to deliver a paint mixture to a coupling for connecting a paint nozzle assembly thereto, in this case in the form of a CCV 22*a* for robotic painting stations, or in some cases a quick connect attachment or regulator, or sometimes referred to as "acorn" regulators (available from Devilbiss Air Power Company for example), or to another coupling as desired. These regulators have first inlet and a first outlet that are in fluid communication with the drop line and a second outlet which is coupled with a manual paint spray gun. In this case, the regulating function of this particular regulator is at the second outlet and not between the first inlet and first outlet, so that it induces a very small pressure drop and presents essentially no source of paint settling in the drop line itself.

The paint drop line 20*a* is also provided with a flow induced pressure generating unit for developing a differential pressure in the paint drop line. In this case, the flow induced pressure generating unit is provided in the form of a coil assembly 24*a*, which includes a coil of tube having a number of coil parameters, including inner tube diameter, a coil diameter, a coil length, and a coil pitch, all chosen to provide the required flow induced differential pressure in the paint drop line 20*a*, together with the other differential pressure generating effects of the tubing in the drop line both upstream and downstream of the coil assembly 24*a*.

In this case, the number of drop lines will determine the design flow rates from node to node in the main supply line 14. For instance, the flow rate between nodes 16*a* and 16*b* in the supply line will equal the flow rate leaving the supply station minus the flow rate in the drop line 20*a*. Similarly, the flow rate between nodes 16*b* and 16*c* in the supply line will equal the flow rate leaving the supply station minus the flow rate in the drop line 20*a*, minus the flow rate in the drop line 20*b*.

Knowing these flow rates, the pressures at each of the supply and return nodes can be calculated by determining the pressure loss as result of the corresponding flow rates passing through each component in the system For example, the pressure at the back pressure regulator 12*d* and the pressure at the pump 12*b* is known and the pressure at the last return node 21*j* can be calculated by determining the pressure loss between it and the back pressure regulator 12*d*. Considering the flow through each supply line to be equal, the pressure loss along each of the drop lines can be determined and the incremental pressure loss between neighbouring supply nodes and between neighbouring return nodes can similarly be calculated.

All components in the drop line will create some pressure drop. The coil is used to provide the correct amount of pressure drop in order to obtain the design flow rate for each drop line. The percentage of pressure drop provided in a single drop line by the coil can vary significantly depending on the nature of drop tubing. This means that the entire pressure drop between the supply and return nodes is used to produce an actual flow rate according to the design flow rate in the drop. The flow in this arrangement is very stable and will not change substantially with small changes in the system. This design forces the correct flow rate in each parallel drop line. The inherently robust design allows the elimination of many of the of dirt creating components usually found in conventional paint systems, such as standpipes, isolation diaphragms, and pressure regulators. When the viscosity of the coating material in the system 10 is changed while the flow rate leaving the supply station remains the same, the flow rates in the drop lines should also remain the same. No one drop line should see a change in flow conditions that is not applied equally across the drop lines. Any flow induced pressure changes as a result of the viscosity change should be applied equally across the drop lines. Consequently, the flow rates should remain substantially unchanged and, hence, remain balanced.

The system 10 also provides significant benefits when it must be cleaned due to a change in material, colour or the like. This cleaning task requires that all traces of the previous coating material and/or colour be removed so as not to contaminate the new coating material.

The present system 10 will cause the cleaning solvent/fluids to distribute among drop lines, which means that, surprisingly, the cleaning function can occur easily from the main supply station and should require no intervention in the paint booth or adjacent production area. It should be noted here that this cleaning procedure occurs upstream of the CCV. The CCV itself allows the paint gun and any piping joining the paint gun to the CCV to be changed from one material/colour to the next. Furthermore, when the new material is loaded into the supply station, no adjustments should be needed from one drop line to the other.

A particular feature of the system 10 is that each paint drop line is substantially free of one or more components that will allow the paint velocity to slow down to a point where settling of solids may occur to such an extent as:

1) to cause pressure changes to a degree requiring that the system be recalibrated; and/or
2) to cause settled solids to be deposited on a painted surface to a degree requiring remedial repair.

The system 10 thus makes use of flow balancing coils to provide a robustly relatively stable, relatively low maintenance, metallic flake friendly, paint circulation system, in which the amount of dirt produced is substantially reduced, while at a significant cost savings.

The pressure differential across the paint drop lines is chosen to be a value that will make the balancing of the system robust. In other words, there is sufficient pressure differential from the supply node to the return node to reduce the effects of minor pressure fluctuations occurring anywhere in the system so that they have only a minor effect on flow rate through the paint drop lines. In this particular example, a suitable operating pressure differential between a supply and return node may range from about 25 to about 50 psi, more preferably about 30 to about 40 psi. In this case, a change of 2 psi in the operating differential pressure would produce a flow rate change of about 8% to about 4% or 6.6%-5%. This can be contrasted with prior art paint circulation systems wherein the same 2 psi change in the operating pressure differential (that is between the pressure differential between the regulator/pressure reducing valve and the return node) can cause as much as a 100% change in flow rate changes, either doubling the flow rate or completely shutting off the flow rate.

In one example paint system, the coils may be made from ¼ inch stainless steel tubing×0.035 inch wall thickness with coils being 4 inches in diameter on a half inch pitch. The overall tube length of each coil may be held at 20 inches and the number of coils inside this length may be varied to change the overall resistance, the greater the number of coils, the greater the resistance. The coil parameters may be determined by the particular application. For example, for most paint circulation systems for automobile assembly lines or for similar applications, it is contemplated that the stainless steel tubing may have a diameter ranging from about ⅛ inches to about ½ inch, a wall thickness ranging from about 0.020 inches to about 0.065, a coil diameter ranging from about 0.5 inches to about 12 inches and a pitch ranging from about, ⅛ inches to about 1 inch.

In addition, the tubes may be linear or formed into configurations other than the specific configuration used in the system 10. For example, the tubes may be formed into rectangular, or triangular or other shaped coils. The tubes may be of other cross sections, such as oval or rectangular. It will be further understood that some empirical testing may be useful to determine the appropriate shape or other configuration according to the desired pressure differential while taking into account other conditions, such as the available space in a manufacturing facility for the circulation system in question. It will also be understood that different shapes will influence the pressure differential differently, for example because of the varying frictional effects of bends of varying included angle, decreasing tube diameter and with the minor losses generally increasing with an increasing included angle.

The coil configuration is a convenient form of flow induced pressure generator since its tubing imposes negligible shear forces on the coating material. The tubing, however, can may take many different forms, the coil being particularly useful because it provides many different lengths of tube to fit into a compact space and allows fractions of a coil to be made to match the specified flow induced pressure according to the conditions for that particular drop line. The coil allows the start and end points of the tube to be collinear with the same overall length between start and end points and allows the supply and return channel as well as the drop line piping in a large circulation system to be installed in a neat form prior to finalizing the actual number of turns in each coil. This means that the tubing in each parallel drop line and the coil can be accurately measured and the coils similarly configured. While the coil is the preferred arrangement of low shear proportional pressure inducing tubing, other arrangements may can be used. This includes, but is not limited to, different tubing sizes and diameters, different shapes of the tubing such as straight lengths, elliptical, angular, rectangular and the like.

The above systems refer to drop lines between the supply and return lines. There may be cases where a number of drop lines in a system are not actually in use, perhaps because a system is installed with the capacity to handle more spray gun assemblies than required in most cases, thereby providing a contingency. In this case, the drop lines is still installed with as short a distance from the supply node to the return node as possible with an appropriate sized coil. This maintains all drop lines active.

Figure 3:
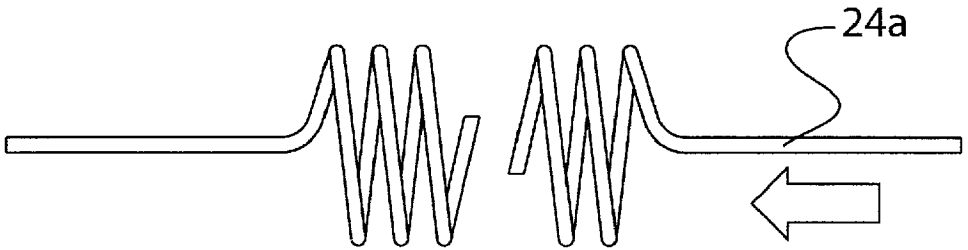
FIG. 3 is a side view of one component of the system of FIG. 2.
Figure 4:
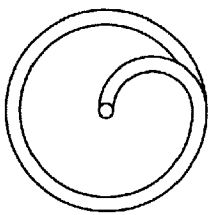
FIG. 4 is a view taken on arrow 4 of FIG. 3.

As can be seen in FIGS. 3 and 4, the supply and discharge tubes of the coil assembly 24*a* are run along the center axis of the coil in order to allow a fractional number of coils to be used. This allows the resistance of each coil to be finely tuned to the required resistance to balance the flow in each paint drop line.

It should be pointed out that the differential pressure across each drop line may be different from one drop line to the next, in which case the parameters for the coil may be unique for each drop line. This is due to the fact that different components may be present in each drop line, since each drop line is likely to be routed to a different location in a paint booth, for example involving different lengths of piping, different numbers of "90" and "45" degree piping connectors and other equipment.

In this case, the general procedure is to determine the Available Differential Pressure across each drop line, which is determined by subtracting the absolute return node pressure from the absolute supply node pressure. The pressure drop needed at the coil, then, is determined by subtracting from the Available Differential Pressure, the pressure drop that is created by the losses in the various components in the drop line including measured tubing and minor losses due to fittings, bends, CCV and the like. The remaining pressure can then be the basis for the pressure generating characteristics of the coil and is then used to determine the number of turns required in the coil. Thus the coil provides the correct additional amount of resistance to force the actual flows in the drop lines to match the design flow rate in each drop line. In other words, the coils provide the fine tuning by allowing a fraction of a turn, for example 4.5 turns, as needed.

It will be seen in FIG. 2, that the paint supply channel 14 is reduced in diameter as the flow in the pipe decreases downstream in a progressive manner along one or a group of paint supply nodes, until the supply pipe ends with the last supply node 16*j*. Similarly, the paint return channel starts with the return from the first supply node 21*a* and is increased in diameter as the flow increases downstream until the paint return channel joins with the last return node 21*j*.

The diameters of the main supply and return pipes are chosen to give an appropriate velocity and pressure drop rate to guarantee no settling of materials of sufficient size to require remedial repair to a painted surface. Desirably, the flow of paint material is expected, in almost all cases, to have a Reynolds number well within laminar flow conditions. It is believed that actual pressure drops can correspond closely to the predicted or specified pressure drops in these laminar flow conditions. However, there may be some cases where the system can provide beneficial results if any of the drop lines, or the supply or the return channels are functioning in turbulent flow conditions or in laminar-to-turbulent transitional flow conditions, as may occur for instance when piping cleaning solvents through the system.

By using relatively small tube diameter coils and sizing piping correctly, the need for regulators/pressure reducing valves and pressure gauges may be substantially eliminated, as well as the dead spots they would otherwise contribute. Thus, the system has substantially no solids accumulating locations or sites and at the same time is operable to circulate the paint mixture at the required flow velocities that minimize or prevent settling, thus substantially reducing the amount of dirt being delivered to the painted body, especially dirt of the degree requiring remedial repair. The evaluation of what requires remedial repair may involve a subjective evaluation by a paint inspector or may involve automated paint analysis systems, where a threshold is determined for the need for remedial repair. For example, the inspector or automated system may determine that the presence of dirt on the painted surface is too small to be discerned by the naked eye or some other criteria, such as minimum particle size, minimum surface disruption, or perhaps a minimum in the apparent depth or reflective or scattering quality of the paint finish.

A side by side comparison of painted surfaces from a prior art system and painted surfaces from an example of the system 10 has demonstrated a significant (for example in the order of 40 percent) reduction in dirt in the surface of the paint applied by the system 10.

Furthermore, the system 10 accommodates changes in paint viscosity, so that changes due to variations in the mix room, batches, or new colours may be implemented, during which the system will remain substantially balanced. In other words, changes can be made at the central paint supply station such as adjustments to paint pump speed and the back pressure regulator. In this case, the term "balanced" is intended to mean that each and every paint drop line in the system will have the intended design flow rate of paint running through the paint drop line. The system 10 should, eliminate the need to balance the system, even when flushing with solvents that are in the turbulent flow range. The balance from drop line to drop line should be robust, thus substantially minimizing, if not eliminating, the risk that drop lines will plug due small changes in pressure in the system. The metallic flake degradation is virtually eliminated because the coils are low shear devices.

The present system 10 also enjoys a savings in capital cost over the prior art systems since the pressure reducing valve, tees, stand pipes, isolation valves, snubbers or diaphragms and pressure gauges normally found in the drop lines of conventional systems are essentially avoided which means their purchase, maintenance and eventual replacement through the life of the system are also essentially avoided.

The system 10 may be used as follows. First, the system 10 is planned including the number of drop lines and paint spray gun assemblies (or other paint output nozzle assembles) as needed. Next, the operative pressure conditions of the system are specified by determining the required flow rate and then determining the pressure differential between the supply and return nodes of the drop lines that will be generated when the desired flow passes through the drop lines, and in particular through the coil. The required minimum pressure for a spray gun assembly is determined and the pressure setting for the back pressure regulator 12*d* is adjusted such that this minimum pressure for a spray gun is provided at the return node 21*j* for the last drop line in the paint circulation system. This should provide all drop lines with an adequate supply pressure available for the paint spray gun assemblies in the booth. With those calculations made, the system is assembled with the required number of paint drop lines between a paint supply channel and a paint return channel. Each drop line is provided with the CCV or similar coupling to connect at least one spray gun assembly to each paint drop line. A coil (or other flow induced differential pressure generator as described above) is provided in each drop line and the flow controlling differential pressure is established by configuring the coil in each drop line to produce the required pressure differential for the design flow to pass through the coil.

Figure 5:
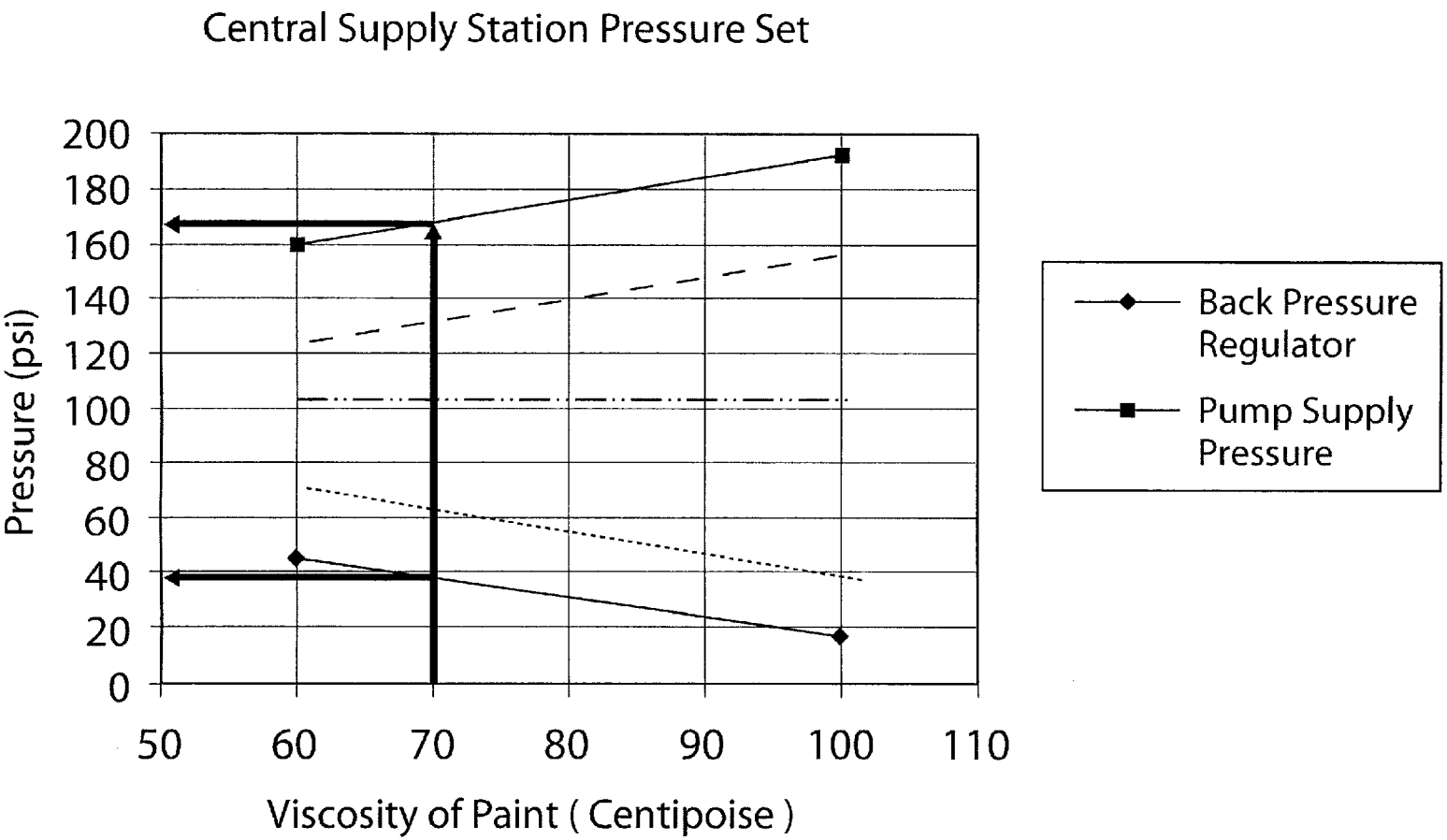
FIG. 5 is a graphical representation of different operating parameters of the paint system of FIG. 2.

An example of an installation can be seen in FIG. 5 which provides a graph for two paint mixtures passing through the same circulation system, where the first paint mixture has a viscosity of 60 centipoise and the second paint mixture has a paint viscosity of 100 centipoise. Each viscosity condition requires different pressure levels at the paint pump discharge and the back pressure regulator in order to maintain the planned design flow rates through each parallel flow path. The graph therefore presents two plots, one for the supply side pressure and the other for the return side pressure. As shown by the dashed lines, a plot of this kind can be prepared for a number of landmarks in the systems, such as at one or more of the supply or return nodes, one or more of the CCV's or the like, where each landmark either has its own plot or sufficient other data is available for the plot to be interpolated or extrapolated. FIG. 5 also includes a double chain dotted line which represents a landmark in the system in which the pressure is substantially unchanged through a range of paint viscosities. This line may represent the last return node in the system or it may represent a node upstream therefrom.

In this example, it is important that the minimum pressure at the last return node be maintained, since all other nodes are upstream and will therefore have pressures higher than the minimum pressure. This means that an operator can measure the actual paint viscosity at the central supply station reservoir tank and, from a plot such as that provided by FIG. 5, determine what the pressure levels should be and can then set the central paint pump supply and the back pressure regulator accordingly. This can, in most cases, establish the design flow rates at any viscosity in the paint drop lines. The phrase "change in viscosity" is intended to refer to those changes in viscosity of the fluid being pumped through the tubing of the material coating circulation system to be seen in the environment of a material coating line, for example ranging from a cleaning solvent with a relatively low viscosity, for example 0.5 centipoise, to a primer coating with a relatively high viscosity, for example 150 centipoise, it being understood that other viscosities may also be applicable.

In the example shown in FIG. 5, a predetermined level of flow can be maintained through the paint circulation lines by adjusting the back pressure regulator and the pump supply with no additional adjustments made to the system. For example, if the paint viscosity is 70 centipoise, the back pressure regulator may be set at about 38 psi and the pump supply pressure at about 170 psi. On the other hand, if the paint viscosity is increased to 100 centipoise, the pressure in the back pressure regulator is reduced to just under 20 psi and the pump supply pressure increased to just over 190 psi.

Figure 6:
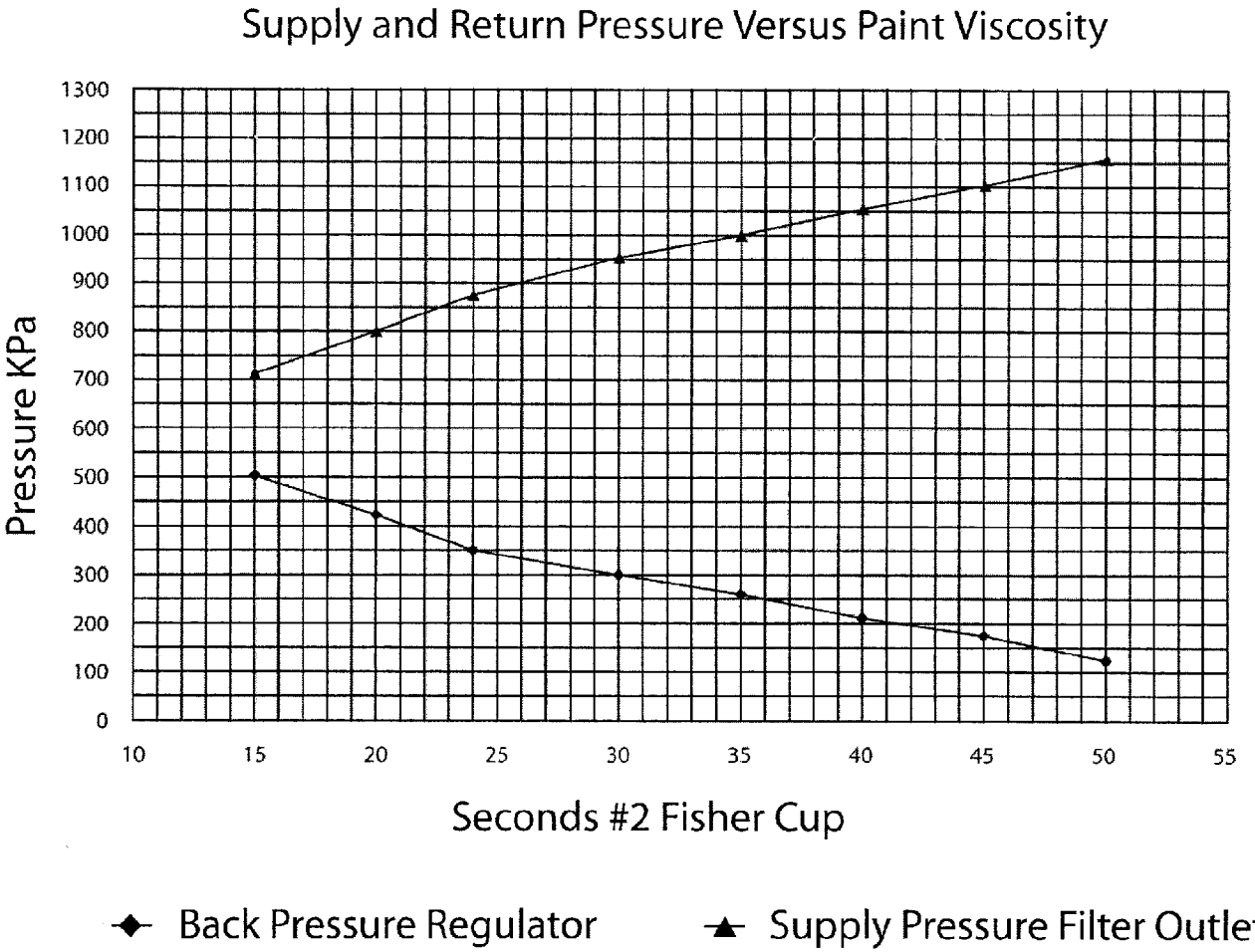
FIG. 6 is a graphical representation of another set of operating parameters of the paint system of FIG. 2.
Figure 7:
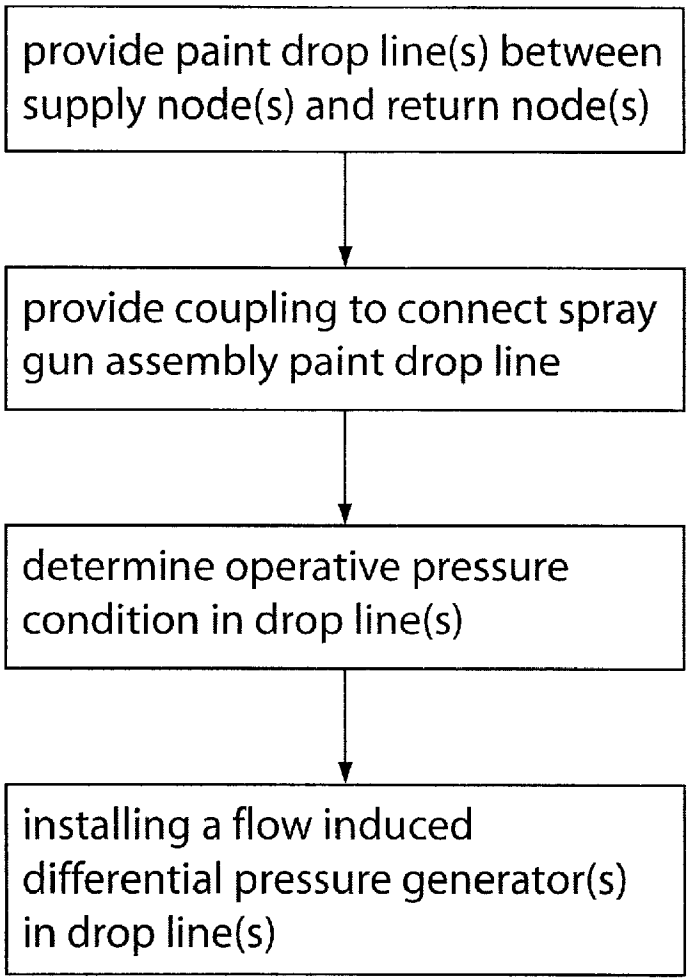
FIG. 7 is a flow diagram of a method of supplying a paint mixture.

Another example is shown in FIG. 6, which provides a graph for eight coating mixtures passing through the same circulation system, each with viscosities ranging from 15 seconds to 50 seconds using a #2 Fisher cup. In this case, the upper supply side pressure plot has a slightly steeper slope than the lower return side pressure plot. This is due to the fact that the pressure at the last return node was set at 550 kPa and was relatively closer to the return regulator through the return channel, than the pump through the supply channel. In this case, the supply pressure was the automatic set point at the pump and the return pressure was the back pressure regulator set point at the reservoir tank.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

While the present system 10 is used in the context of an automobile assembly line, it will be understood that the system may be used for other assembly lines such as those manufacturing industrial products or consumer products.

The invention claimed is:

1. A paint system comprising a paint supply station, a paint supply channel downstream of the paint supply station, the paint supply channel having a number of supply nodes, a paint return channel upstream of the paint supply station, the paint return channel having a number of return nodes, and a number of paint circulation lines, wherein the number of paint circulation lines includes:

a first paint circulation line including a first coupling for connecting a first paint output nozzle assembly thereto, the first paint circulation line being positioned downstream of the paint supply channel at a first supply node of the number of supply nodes, the first paint circulation line being positioned upstream of the paint return channel at a first return node of the number of return nodes, the first paint circulation line further comprising a flow induced pressure generating portion including one or more first lengths of coiled tubing for developing a first differential pressure in the first paint circulation line, the first differential pressure being proportional to the magnitude of paint flow therein, first length of coiled tubing being shaped to generate sufficient differential pressure to provide an operative first pressure differential at the first paint output nozzle assembly, and a second paint circulation line including a second coupling for connecting a second paint output nozzle assembly thereto, the second paint circulation line being positioned downstream of the paint supply channel at a second supply node of the number of supply nodes, the second paint circulation line being positioned upstream of the paint return channel at a second return node of the number of return nodes, the second paint circulation line further comprising a second flow induced pressure generating portion including at least one second length of coiled tubing for developing a second differential pressure in the second paint circulation line, the second differential pressure being proportional to the magnitude of paint flow therein, the second length of coiled tubing being different from the first length of coiled tubing and being shaped to generate sufficient differential pressure to provide an operative second pressure differential at the second paint output nozzle assembly, wherein each paint circulation line is substantially free of a component of sufficient size to cause accumulation of settled paint solids that cause at least one of pressure changes of a magnitude requiring system recalibration or settled solids to be deposited on a painted surface to a degree requiring remedial repair.

2. A system as defined in claim 1 wherein the paint output nozzle assembly includes a paint spray gun.

3. A system as defined in claim 1 wherein the coupling is a at least one of color change valve and a manual flow through regulator with or without a quick disconnect.

4. A system as defined in claim 1 wherein the differential pressure in each paint circulation line is produced entirely by a combination of differential sub-pressures including a first sub-pressure produced by the flow induced pressure generating portion, a second sub-pressure produced by paint circulation line and the coupling and without a pressure regulator, or pressure reducing valve or a pressure gauge assembly or a combination thereof.

5. A system as defined in claim 1, further comprising an output nozzle assembly in fluid communication with the coupling of each paint circulation line, the output nozzle assembly including one or more paint spray guns, flow meters, air operated pressure regulators, servo driven flow controllers and/or flushing systems.

6. A system as defined in claim 1, wherein the length of coiled tubing has one or more predetermined coil parameters, including inner tube diameter, coil diameter, coil length, and coil pitch, one or more of which being selected according to a predetermined flow induced differential pressure.

7. A system as defined in claim 1, wherein one or more than one length of coiled tubing has an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch.

8. A system as defined in claim 1, wherein each length of coiled tubing is formed from stainless steel materials.

9. A paint system comprising a paint supply station, a paint supply channel downstream of the paint supply station, the paint supply channel having a number of supply nodes, a paint return channel upstream of the paint supply station, the paint return channel having a number of return nodes, and a number of paint circulation lines including a first circulation line and a second circulation line, the first circulation line including a coupling for connecting a first paint output nozzle assembly thereto, the first paint circulation line being positioned downstream of the paint supply channel at a first supply node of the number of supply nodes, the first paint circulation line being positioned upstream of the paint return channel at a first return node of the number of return nodes, the first paint circulation line further comprising a flow induced pressure generating portion including at least one first length of coiled tubing for developing a first differential pressure in the first paint circulation line, the first differential pressure being proportional to the magnitude of paint flow therein, the first length of coiled tubing being shaped to generate sufficient differential pressure to provide a first operative pressure differential at the first paint output nozzle assembly, the second paint circulation line including a coupling for connecting a second paint output nozzle assembly thereto, the second paint circulation line being positioned downstream of the paint supply channel at a second supply node of the number of supply nodes, the second paint circulation line being positioned upstream of the paint return channel at a second return node of the number of return nodes, the second paint circulation line further comprising a second flow induced pressure generating portion including at least one second length of coiled tubing for developing a second differential pressure in the second paint circulation line, the second differential pressure being proportional to the magnitude of paint flow therein, the second length of coiled tubing being different from the first length of coiled tubing and being shaped to generate sufficient differential pressure to provide an operative second pressure differential at the second paint output nozzle assembly, and wherein the pressure differential of all paint circulation lines is such that the design flow rate in every paint circulation line is substantially obtained in a stable and robust fashion, wherein changes in viscosity, provided the flow stays in the laminar flow zone, will cause the design flow rates in the paint circulation lines to be substantially maintained.

10. A system as defined in claim 9, wherein a plurality of lengths of coiled tubing are arranged in series or in parallel in a corresponding paint circulation line, further comprising an output nozzle assembly attached to the coupling, the output nozzle assembly further comprising one or more paint spray guns, flow meters, air operated pressure regulators, servo driven flow controllers and flushing systems, the length of coiled tubing having one or more predetermined coil parameters, including inner tube diameter, coil diameter, coil length, and coil pitch, one or more of which being selected according to a predetermined flow induced differential pressure, the length of coiled tubing having an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch.

11. A paint circulation system for supplying a paint mixture to a paint booth in a manufacturing operation, the paint circulation system comprising a number of paint drop lines supplying paint to a number of paint spray gun assemblies, the number of paint drop lines including a first paint drop line and a second paint drop line, the first paint drop line including a first color change valve for connecting a first paint spray gun assembly thereto, each paint spray gun assembly being operative to spray a paint mixture received from the first paint drop line at a first operative flow rate, the first paint drop line being positioned downstream of a first paint supply node and upstream of a corresponding first paint return node, the first paint drop line further comprising a first means for generating differential pressure according to a first operative flow rate, the first means for generating differential pressure including at least one first coiled tubing that is shaped to generate the first differential pressure and is substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof, and the second paint drop line including a second color change valve for connecting a second paint spray gun assembly thereto, the second paint spray gun assembly being operative to spray a paint mixture received from the second paint drop line at a second operative flow rate, the second paint drop line being positioned downstream of a second paint supply node and upstream of a corresponding second paint return node, the second paint drop line further comprising a second means for generating differential pressure according to a second operative flow rate, the second means for generating differential pressure including at least one second coiled tubing that is different from the first length of coiled tubing and shaped to generate the differential pressure and is substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof.

12. A paint circulation system for supplying a paint mixture to a paint booth in an automobile manufacturing operation, the paint circulation system comprising a number of paint drop lines, the number of paint drop lines including a first paint drop line and a second drop line, the first paint drop line including a first color change valve for connecting a first paint spray gun assembly thereto, the first each paint spray gun assembly being operative to spray a paint mixture received from the first paint drop line at a first operative flow rate, the first paint drop line being positioned downstream of a first paint supply node and upstream of a first paint return node, the first paint drop line further comprising a means for generating a first differential pressure according to a first operative flow rate, the means for generating the first differential pressure including at least one length of coiled tubing that is shaped to generate the first differential pressure, the first paint drop line being substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof, wherein the first paint drop line is free of pressure regulators, pressure reducing valves, pressure gauge assemblies, tees, standpipes, isolation valves, isolation diaphragms, or a combination thereof, the second paint drop line including a second color change valve for connecting a second paint spray gun assembly thereto, the second paint spray gun assembly being operative to spray a paint mixture received from the second paint drop line at a second operative flow rate, the second paint drop line being positioned downstream of a second paint supply node and upstream of a second paint return node, the second paint drop line further comprising a means for generating a second differential pressure according to a second operative flow rate, the means for generating the second differential pressure including at least one second length of coiled tubing that is different than the first length of coiled tubing and shaped to generate the second differential pressure and is substantially free of any component or dead spot of sufficient size to cause accumulation of settled solids from a paint mixture to cause pressure changes to a degree requiring that the system be recalibrated or to cause settled solids to be deposited on a painted surface to a degree requiring remedial repair thereof, wherein the second paint drop line is free of pressure regulators, pressure reducing valves, pressure gauge assemblies, tees, standpipes, isolation valves, isolation diaphragms, or a combination thereof.

13. A system as defined in claim 12, wherein the length of coiled tubing has one or more predetermined coil parameters, including inner tube diameter, coil diameter, coil length, and coil pitch, one or more of which being selected according to a predetermined flow induced differential pressure.

14. A system as defined in claim 12, wherein each length of coiled tubing has an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch.

15. A system as defined in claim 12, wherein each length of coiled tubing is formed from stainless steel materials.

16. A paint circulation system for supplying a paint mixture to a paint booth in a manufacturing operation, the paint circulation system comprising a number of paint drop lines, each including a color change valve for connecting a paint spray gun assembly thereto, the number of paint drop lines including a first paint drop line and a second drop line, the first paint drop line including a first color change valve for connecting a first paint spray gun assembly thereto, the first paint spray gun assembly being operative to spray a paint mixture received from the first paint drop line at a first operative flow rate, the first paint drop line being positioned downstream of a first paint supply node and upstream of a first paint return node, the first paint drop line further comprising a first means for generating differential pressure according to a first operative flow rate, the first means for generating differential pressure including at least one first length of coiled tubing, wherein the first length of coiled tubing is shaped to generate the differential pressure and is substantially free of one or more sources of shear induced damage to additives contained in a paint mixture resulting in inconsistencies in a painted surface to a degree requiring remedial repair thereof, the second paint drop line including a second color change valve for connecting a second paint spray gun assembly thereto, the second paint spray gun assembly being operative to spray a paint mixture received from the second paint drop line at a second operative flow rate, the second paint drop line being positioned downstream of a second paint supply node and upstream of a corresponding second paint return node, the second paint drop line further comprising a second means for generating differential pressure according to a second operative flow rate, the second means for generating differential pressure including at least one second length of coiled tubing which is different from the first length of coiled tubing and which is shaped to generate the second differential pressure and is substantially free of one or more sources of shear induced damage to additives contained in a paint mixture resulting in inconsistencies in a painted surface to a degree requiring remedial repair thereof.

17. A system as defined in claim 16, wherein a plurality of the lengths of coiled tubing being formed from stainless steel materials and arranged in series or in parallel in a corresponding paint drop line, one or more than one length of coiled tubing having an inner tube diameter ranging from about ⅛ inch to about ½ inch, a wall thickness ranging from about 0.020 inch to about 0.065 inch, a coil diameter ranging from about 0.5 inch to about 12 inches and a coil pitch ranging from about ⅛ inch to about 1 inch.

18. A paint circulation system for a painting line, comprising:

a supply channel, a return channel, a plurality of drop lines downstream of the supply channel and upstream of the return channel, the plurality of drop lines including a first drop line and a second drop line, first control means located in the first drop line for controlling a first paint flow rate, the first control means including one or more lengths of first coiled tubing shaped to adjust the first flow rate according to a first flow controlling pressure differential, and wherein the first flow controlling pressure differential is the pressure differential across the first drop line between the supply channel and the return channel, second control means located in the second drop line for controlling a second paint flow rate, the second control means including at least one second length of coiled tubing that is different than the first length of coiled tubing and shaped to adjust the second flow rate according to a second flow controlling pressure differential, and wherein the second flow controlling pressure differential is the pressure differential across the second drop line between the supply channel and the return channel, wherein changes to viscosity in the paint do not result in changes to the system requiring recalibration between paint drop lines.

19. A system as defined in claim 18, further comprising a paint output nozzle assembly coupled to each of the paint drop lines, a plurality of the lengths of coiled tubing being arranged in series or in parallel in a corresponding paint circulation line, the output nozzle assembly including one or more paint spray guns, flow meters, air operated pressure regulators, servo driven flow controllers and flushing systems, the length of coiled tubing having one or more predetermined coil parameters, including inner tube diameter, coil diameter, coil length, and coil pitch, one or more of which being selected according to a predetermined flow induced differential pressure, one or more than one length of coiled tubing having an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch, each length of coiled tubing is formed from stainless steel materials.

20. A paint circulation system for a painting line, comprising:

a supply channel, a return channel, a plurality of drop lines downstream of the supply channel and upstream of the return channel, the plurality of drop lines including a first drop line and a second drop line, a paint pump means for circulating paint through the supply channel, the drop lines and the return channel with a corresponding flow rate through each drop line, wherein the first drop line includes first means for establishing a first flow controlling pressure differential between the supply channel and the return channel that is directly proportional to the first paint flow rate, the first means for establishing the first flow controlling pressure differential including one or lengths of first coiled tubing in the first drop line, wherein a change in the first flow controlling pressure differential in the first drop line causes a corresponding proportional change in the first paint flow rate through the first drop line, and wherein the second drop line includes second means for establishing a second flow controlling pressure differential between the supply channel and the return channel that is directly proportional to a second paint flow rate flowing through the second drop line, the second means including a second length of coiled tubing that is different than the first length of coiled tubing and is shaped to establish the second flow controlling pressure differential in the second drop line, wherein a change in the second flow controlling pressure differential in the second drop line causes a corresponding proportional change in the second paint flow rate through the second drop line.

21. A system as defined in claim 20, further comprising a paint output nozzle assembly coupled to each of the drop lines, the lengths of coiled tubing being arranged in series or in parallel in a corresponding paint drop line, each length of coiled tubing having an inner tube diameter, coil diameter, a coil length, and a coil pitch, one or more of which being selected according to a predetermined flow induced differential pressure, one or more than one of the lengths of coiled tubing having an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch.

22. A paint circulation system for an automotive painting line, comprising:

a supply channel, a return channel, a plurality of drop lines, including a first drop line and a second drop line, downstream of the supply channel and upstream of the return channel, a paint pump means operatively connected to the supply channel, the return channel and the first and second drop lines, the first drop line including a first coil to limit changes to a first drop line flow rate in the first drop line to within a proportional change in a first flow controlling pressure differential in the first drop line between the supply channel and the return channel, and the second drop line including a second coil, which is different than the first coil, to limit changes to the second drop line flow rate to within a proportional change in a second flow controlling pressure differential in the second drop line between the supply channel and the return channel.

23. A system as defined in claim 22, further comprising a paint output nozzle assembly coupled to each of the drop lines.

24. A system as defined in claim 22, wherein each length of coiled tubing has an inner tube diameter, coil diameter, a coil length, and a coil pitch, one or more of which being selected according to a predetermined flow induced differential pressure.

25. A system as defined in claim 22, wherein one or more than one length of coiled tubing has an inner tube diameter ranging from about ⅛ inch to about ½ inch, a wall thickness ranging from about 0.020 inch to about 0.065 inch, a coil diameter ranging from about ½ inch to about 12 inches and a coil pitch ranging from about ⅛ inch to about 1 inch.

26. A system as defined in claim 22, wherein each length of coiled tubing is formed from stainless steel materials.

* * * * *

UNITED STATES PATENT AND TRADEMARK OFFICE

CERTIFICATE OF CORRECTION

PATENT NO. : 7,293,720 B2
APPLICATION NO. : 10/698857
DATED : November 13, 2007
INVENTOR(S) : Ramsay It is certified that error appears in the above-identified patent and that said Letters Patent is hereby corrected as shown below:

In column 21, line 40, in Claim 1, delete "paint flow therein, first length of coiled tubing" and insert -- paint flow therein, the first length of coiled tubing --, therefor.

In column 22, line 6, in Claim 3, delete "a at least one of" and insert -- at least one of a --, therefor.

Signed and Sealed this

Nineteenth Day of May, 2009

JOHN DOLL
*Acting Director of the United States Patent and Trademark Office*